US005158005A

United States Patent [19]

Negishi et al.

[11] Patent Number: 5,158,005

[45] Date of Patent: Oct. 27, 1992

[54] ACTUATOR USING ELASTIC EXTENSIBLE MEMBER

[75] Inventors: Koichi Negishi, Kodaira; Teruyoshi Sato, Kawasaki, both of Japan

[73] Assignee: Bridgestone Corporation, Tokyo, Japan

[21] Appl. No.: 540,551

[22] Filed: Jun. 19, 1990

[30] Foreign Application Priority Data

Jun. 19, 1989 [JP] Japan ..... 1-154538

[51] Int. Cl.[5] ..... F01B 19/00

[52] U.S. Cl. ..... 92/92; 92/51; 92/90; 92/91; 92/130 R; 92/130 D

[58] Field of Search ..... 92/51, 90, 91, 92, 130 C, 92/130 D, 130 R

[56] References Cited

U.S. PATENT DOCUMENTS

| | | | |
|---|---|---|---|
| 1,652,879 | 8/1924 | Standerwick | 92/130 C |
| 2,949,895 | 8/1960 | Reuter | 92/92 |
| 3,481,254 | 12/1969 | Wetherbee | 92/92 |
| 4,615,260 | 10/1986 | Takagi et al. | 92/92 |
| 4,721,030 | 1/1988 | Paynter | 92/92 |
| 4,784,042 | 11/1988 | Paynter | 92/92 |
| 4,841,845 | 6/1989 | Beullens | 92/92 |
| 4,939,982 | 7/1990 | Immega et al. | 92/92 |
| 4,974,497 | 12/1990 | Krauter | 92/92 |

*Primary Examiner*—Edward K. Look
*Assistant Examiner*—Todd Mattingly
*Attorney, Agent, or Firm*—Sughrue, Mion, Zinn, Macpeak & Seas

[57] ABSTRACT

An actuator includes an elastic member extensible in axial directions when a pressurized fluid is supplied into the elastic member, and guiding device arranged outwardly of the elastic member and permitting the elastic member to move in the axial directions, but restraining the elastic member from moving in directions intersecting the axial directions. As the actuator is of an air-bag type so that energy of the pressurized fluid can be converted into mechanical movement with high efficiency. The actuator moves only in axial directions without expanding in radial directions, so that the actuator takes up little space in operation.

10 Claims, 3 Drawing Sheets

ACTUATOR USING ELASTIC EXTENSIBLE MEMBER

BACKGROUND OF THE INVENTION

This invention relates to an actuator using an elastic extensible member extending in axial directions by either supplying or exhausting a pressurized fluid into and from the elastic extensible member.

Electric motors, hydraulic cylinders and the like have been known as actuators. However, an electric motor usually requires a speed reduction mechanism including gear trains to increase weight and space to be occupied by the actuator and often suffers a limitation of operable range. Moreover, due to the occurence of unavoidable sparks, use of the actuator in an explosion atmosphere is limited.

In contrast herewith, with hydraulic cylinders including motors and cylinders actuated with oil pressure, in addition to the above problems it is difficult to completely prevent leakage of operating oil so that environmental contamination by the leaked oil could not be avoided. Moreover, the temperature and purity of the operating oil must be finely managed and there are many other problems to be solved in management of the hydraulic cylinders.

In addition, in order to obtain an actuator having a high power, it will be unavoidably large sized.

SUMMARY OF THE INVENTION

It is an object of the invention to provide an improved actuator which eliminates all the disadvantages of the prior art and is small-sized, light weight, free from environmental contamination and exhibits high power.

In order to accomplish these objects, an actuator using an elastic extensible member according to the invention comprises an elastic member extensible in axial directions when a pressurized fluid is supplied into the elastic member, and guiding means arranged outwardly of the elastic member and permitting the elastic member to move in the axial directions, but restraining the elastic member from moving in directions intersecting the axial directions.

The elastic extensible member is of so-called air-bag type which is able to extend upon being supplied with a pressurized fluid and return to its original size when the pressurized fluid is exhausted therefrom. Therefore, the energy of the pressurized fluid is converted into mechanical movement with high efficiency.

Moreover, the guiding means arranged outwardly of the elastic extensible member serves to restrain the elastic extensible member from moving in directions intersecting the axial directions without obstructing the extending and returning to its initial dimensions. Therefore, the elastic extensible member does not bend in operation so that the moving directions of the actuator is assured. Consequently, the invention provides an actuator which is small-sized and light weight and exhibits high power output.

The invention will be more fully understood by referring to the following detailed specification and claims taken in connection with the appended drawings.

DETAILED DESCRIPTION OF THE PREFERRED EMBODIMENTS

Figure 1:
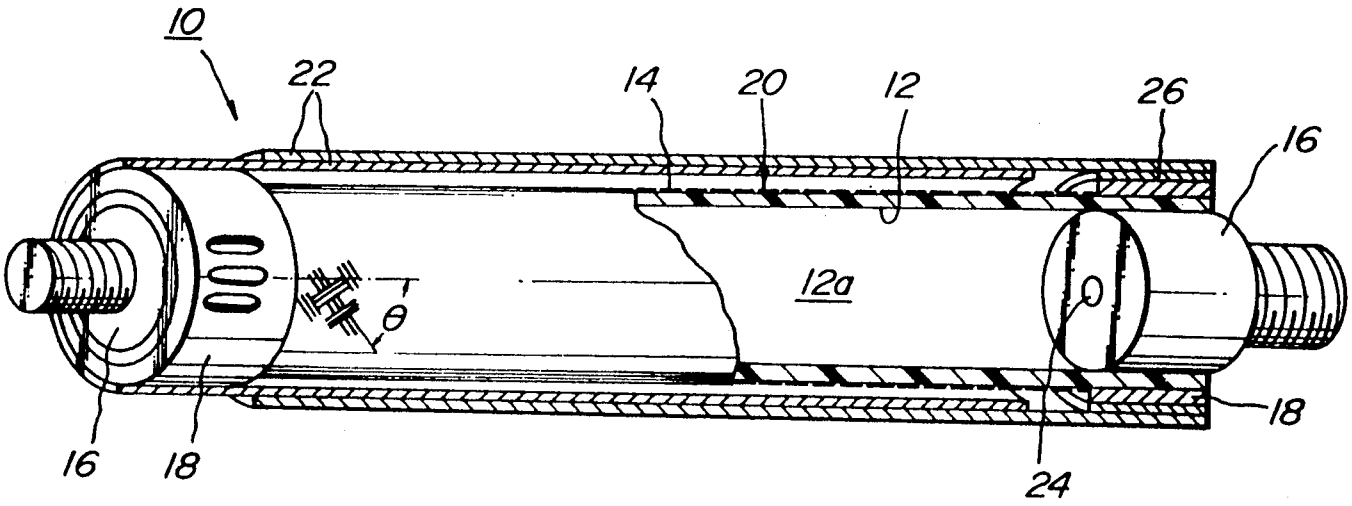
FIG. 1 is a perspective view illustrating the actuator according to the invention in partial section.

FIG. 1 illustrates in section an actuator 10 using an elastic extensible member according to the invention. A tubular body 12 is surrounded by a reinforcing braided structure 14 and closed at both open ends by closure members 16. In order to securely prevent the tubular body 12 and the reinforcing braided structure 14 from being dislodged, these members are externally pressed by clamp sleeves 18 to form an elastic extensible member 20. Outwardly of the elastic extensible member 20 are arranged as guiding means in this embodiment a pair of telescopical cylinder members 22 whose ends are fixed to the clamp sleeves, respectively. In this manner, the actuator relating to the invention is constructed.

The tubular body 12 is preferably made of a rubber or rubber-like elastomer or other materials equivalent thereto, which are impermeable to pressurized fluids such as pressurized air, liquid and the like and superior in flexibility permitting of the tubular body sufficiently expanding when the pressurized fluid is applied. The reinforcing braided structure 14 is reinforced by cords which are organic or inorganic high tensile fibers, for example, polyester fibers or aromatic polyamide fibers (trade name, KEVLAR) or twisted or nontwisted filament bundles such as very fine metal wires. Braided structures may be used whose braided angles change from an initial braided angle $\theta_0$ to a so-called an angle of repose (54°44') at the maximum elongation of the tubular body 12 in the axial direction when applied the pressurized fluid. Moreover, the initial braided angle $\theta_0$ may be selected within angles of the order of 70° to 85°.

At least one of the closure members 16 closing both the ends of the tubular body 12 and the reinforcing braided structure 14 is formed with a connecting aperture 24 for supplying and exhausting a pressurized fluid into and out of an internal space 12*a* of the tubular body 12.

The closure members 16 may be made of a metal. However, it may be preferably made of so-called engineering plastics in order to make the actuator 10 more light weight.

In the embodiment, moreover, each of the closure members 16 is provided on an external end face with a projection extending in its axial direction. The projection is formed with a male screw which is threadedly engaged with a female screw formed in a suitable fixing member or a driven member, thereby enabling the actuator to be integrally fixed to such a member. However, the connection is not limited to such a thread-screw connection, but various modifications can be effected. For example, the projection is formed with a pin-shaped aperture, and a pivot pin secured to a fixing member or driven member is inserted into the pin-shaped aperture for this purpose.

One end of each of the pair of the telescopical cylinder members 22 as guiding means is fixed to the clamp sleeve 18 by means of known fixing means, for example, set screws or tapping screws.

In this embodiment, one of cylinder members 22 having an inner diameter substantially equal to an outer diameter of the clamp sleeve 18 is directly secured to the clamp sleeve 18, while the other cylinder member 22 to be externally fitted on the former cylinder member 22 is secured to the other clamp sleeve 18 through a spacer 26 fixed to an outer circumference of the associated clamp sleeve 18. In order to accomplish smooth relative movements, the cylinder members 22 are preferably made of a material having a small friction coefficient, for example, polytetrafluoroethylene or coated with the material over their relatively sliding surfaces.

The elastic extensible member 20 comprises the tubular body 12 having the outer circumference surrounded by the reinforcing braided structure 14 and both open ends sealed by the closure members 16 as above described. The telescopical cylinder members 22 are not limited to those shown in the above embodiment, but sufficient to be constructed to permit the elastic extensible member 20 to move in its axial direction, but to restrain the member 20 from moving in directions intersecting the axial directions.

Figure 2A:
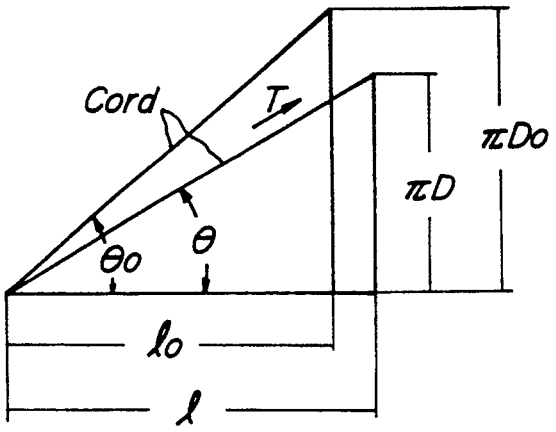
FIGS. 2*a* and 2*b* are explanatory views illustrating the operation of the actuator shown in FIG. 1 and the relationship between the extending force and the extension coefficient.
Figure 2B:
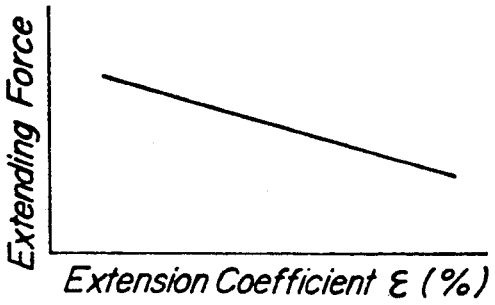

The operation of the actuator 10 according to the invention will be explained referring to FIGS. 2*a* and 2*b*. For the sake of clarity, it assumed that lengths of cords constituting the reinforcing braided structure 14 are invariable.

When an initial braided angle of the cords constituting the reinforcing braided structure 14 relative to the axis of the tubular body 12 is $\theta_0$ and the braided angle of the cords after elongated or deformed by applying the pressurized fluid is $\theta$, the following equations are obtained from balance of forces in the axial directions of the tubular body 12 and circumferential directions intersecting the axial directions.

$$nT\cos\theta=\pi/4\cdot D^2P+F \quad (1)$$

$$2nT\sin\theta=\pi D^2/\tan\theta\cdot P \quad (2)$$

, where n is the number of the cords, T is tensile force acting upon each cord of the reinforcing braided structure, D is a diameter of the reinforcing braided structure at a center of the cord, P is a pressure of the pressurized fluid applied to the elastic extensible member 20, and F is an extending force caused in the elastic extensible member.

Eliminating T from the equations (1) and (2), an equation (3) is obtained.

$$F=nT\cos\theta-\pi/4\cdot D^2P=\pi/4\cdot D^2P(1-2/\tan^2\theta) \quad (3)$$

It can be understood from the equation (3) that the extensible force becomes zero, when $\theta$ is an angle of repose, that is to say, 54°44′.

On the other hand, consideration of the fact that the lengths of the cords are invariable, $\pi D/\sin\theta=\pi D_0/\sin\theta_0$, which can be changed into an equation (4).

$$D=\sin\theta/\sin\theta_0\cdot D_0 \quad (4)$$

On the other hand, an extension coefficient $\epsilon$ of the elastic extensible member is obtained by considering of FIG. 2*b* as follows.

$$\epsilon=(l-l_0)/l_0=(\cos\theta-\cos\theta_0)/\cos\theta_0 \text{ and } \cos\theta=(1+\epsilon)\cos\theta_0 \quad (5)$$

In this case, the extending force F is obtained by substituting the equations (4) and (5) into (3).

$$F=\pi/4\cdot D_0^2P\cdot K \quad (6)$$

where $K=1/\sin^2\theta_0\cdot(1-3(1+\epsilon)^2\cos^2\theta_0)$.

On the other hand, as $\pi/4\cdot D_0^2P$ is equivalent to the output of the cylinder having the effective diameter $D_0$, it is understood that the extending force F of the elastic extensible member 20 is substantially K times the output of the cylinder having the effective diameter $D_0$.

Therefore, in the case, for example, that the initial braided angle $\theta_0$ is 80°, when the extension coefficient $\epsilon$ of the elastic extensible member is zero (%), $K\approx0.94$. If $e=20\%$, $K\approx0.90$. If $e=50\%$, $K\approx0.82$. Relations between the extension coefficient $\epsilon$ and the extending force F are shown in FIG. 2*b*.

Moreover, it is assumed that the initial braided angle $\theta_0$ of cords of the reinforcing braided structure is 80° and in applying pressurized fluid the cords have been deformed to the angle of repose (54°44′). The extension coefficient $\epsilon$ in this case is 2.32 from the equation (5). Therefore, it is clear that the elastic extensible member is extensible to a great extent.

On the other hand, even if such a great extension is effected, the diameter D of the elastic extensible member after deformation is indicated as follows.

$$D=\sin(54°44')/\sin(80°)\cdot D_0\approx0.83D$$

Therefore, it is understood that the elastic extensible member hardly deforms in radial directions in comparison with its axial movements. In other words, the actuator according to the invention does not expand in radial directions with exception of the axial movements. Accordingly, the actuator needs no space for accommodating expansion in radial directions as air-bag type actuators of the prior art.

Figure 3A:
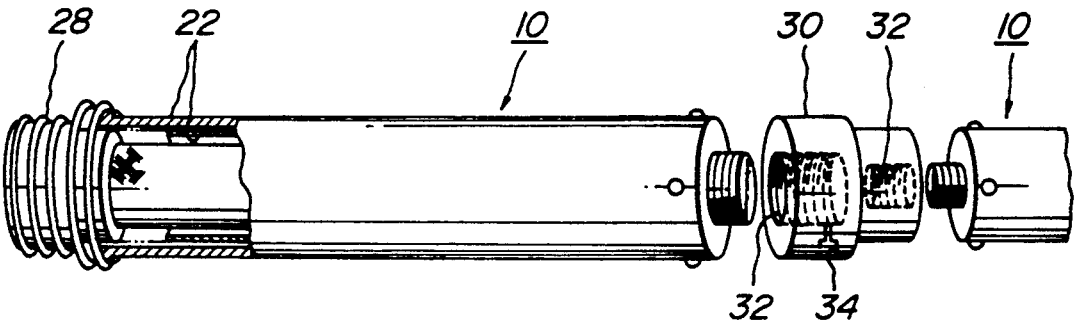
FIG. 3*a* is a perspective view illustrating another embodiment of the actuator according to the invention.
Figure 3B:
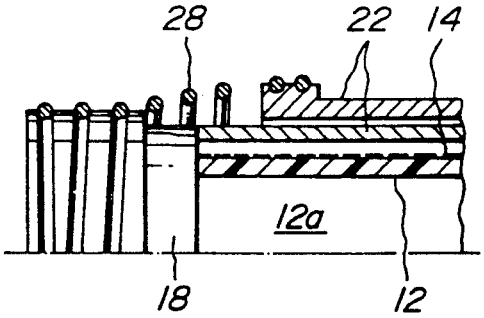
FIG. 3*b* is a partial enlarged view of the actuator shown in FIG. 3*a*.

FIGS. 3*a* and 3*b* illustrate another embodiment of the actuator according to the invention. In this embodiment, an elastic member is provided at one end of the guiding means, in order to accomplish quicker returning of the elastic extensible member 20 to its original dimensions when the pressurized fluid is exhausted from an internal space 12*a* of the elastic extensible member 20. According to this embodiment of the invention, one end of a conically-shaped coil spring 28 as one example of the elastic member is secured to one free end of the cylinder member 22 as the guiding member, while the other end of the coil spring 28 is fixed to the associated clamp sleeve 18. In more detail, one end of the coil spring 28 is fitted in a spiral groove formed in an outer circumference of an annular projection radially outwardly extending from the cylinder member 22 in the proximity of its free end.

In this embodiment, moreover, the closure member 16 is formed in its projection with a male screw which is threadedly engaged in a female screw formed in a connecting bracket 30 as shown in FIG. 3*a*. A series of actuators are consecutively connected by means of such connecting brackets 30.

In this case, the connecting bracket is preferably formed with the female screws on opposite ends so that a plurality of actuators are easily connected. Moreover, the connecting bracket is further formed with a connecting aperture opening at both the female screws 32 so that the pressurized fluid is supplied into or exhaust from two associated actuators 10 simultaneously.

Individual single connecting brackets 30 may of course be formed with connecting apertures associated with respective actuators, in order to enable the respective actuators to be supplied with the pressurized fluid. Moreover, by suitably selecting the shape of the connecting brackets, three or more actuators can be connected.

On the other hand, moreover, although a plurality of actuators are connected in series in this embodiment, they may be connected in parallel to obtain a high power actuator unit.

The invention is not limited to the above embodiments and various changes and modifications may be made in the invention without departing from the spirit and scope thereof. For example, position detecting means such as linear encoders, differential transformers or the like are arranged in connection with the telescopical cylinder members so that displacement of the actuator can be detected.

As can be seen from the above explanation, the actuator according to the invention is of the air-bag type so that the energy of the pressurized fluid can be converted into mechanical movement with high efficiency. Moreover, the invention can provide an actuator which is small-sized and light weight in comparison with actuators of the prior art. Moreover, the actuator according to the invention moves only in axial directions without expanding in radial directions, so that a space occupied by the actuator in operation is little.

If the pressure of the pressurized fluid is kept constant, control of force for the actuator can be effected because of the extending force and the extension coefficient being in a proportional relationship.

What is claimed is:

1. An actuator comprising: an elongate and flexible elastic member including a tubular body and a reinforcing braided structure surrounding the tubular body, said elastic member having first and second axial end portions with said first end portion axially movable relative to said second end portion as a pressurized fluid is either introduced into or exhausted from the tubular body; and guide means arranged outwardly of the elastic member for permitting axial movement of the elastic member while simultaneously restraining the elastic member from moving in directions intersecting an axial direction of the elastic member; wherein said elastic member is movable in its axial direction as a pressurized fluid is exhausted from the tubular body, said braided structure having an initial braided angle which is greater than the angle of repose of 54°44'.

2. An actuator as set forth in claim 1 wherein said elastic member further comprises closure members closing both open ends of the tubular body, and clamp sleeves for preventing the tubular body and the reinforcing braided structure from being dislodged.

3. An actuator as set forth in claim 1, wherein said guiding means comprises a pair of telescopical cylinder members, whose outward ends are connected to the elastic member.

4. An actuator as set forth in claim 1, wherein said guiding means is provided at one end with elastic means for quickly returning the elastic member to its original dimensions when the pressurized fluid is exhausted from the elastic member.

5. An actuator as set forth in claim 4, wherein said elastic means is conically shaped coil spring whose ends are secured to telescopical cylinder members, respectively, which constitute said guiding means.

6. An actuator as set forth in claim 1, further comprising a connecting bracket threadedly connecting two actuators together.

7. An actuator as set forth in claim 6, wherein said connecting bracket is formed with female screws on opposite ends for connecting a second actuator.

8. An actuator as set forth in claim 7, wherein said connecting bracket is formed with a connecting aperture opening at both the female screws for supplying or exhausting the pressurized fluid into or from two associated actuators.

9. An actuator as set forth in claim 1, wherein said elastic member is movable in its axial direction as a pressurized fluid is introduced into the tubular body, said braided structure having an initial braided angle which is within a range of 70° to 85°.

10. An actuator comprising: an elongate and flexible elastic member including a tubular body and reinforcing braided structure surrounding the tubular body, said elastic member having first and second axial end portions with said first end portion axially movable relative to said second end portion as a pressurized fluid is either introduced into or exhausted from the tubular body; and guide means arranged outwardly of the elastic member for permitting axial movement of the elastic member while simultaneously restraining the elastic member from moving in directions intersecting an axial direction of the elastic member; wherein said elastic member is movable in its axial direction as a pressurized fluid is introduced into the tubular body, said braided structure having an initial braided angle which is within a range of 70° to 85°.

* * * * *